US010283260B2

(12) United States Patent
Lee

(10) Patent No.: US 10,283,260 B2
(45) Date of Patent: May 7, 2019

(54) TRANSFORMER FOR REDUCING EDDY CURRENT LOSSES OF COIL

(71) Applicant: LSIS CO., LTD., Anyang-si, Gyeonggi-do (KR)

(72) Inventor: Seungwook Lee, Cheongju-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 292 days.

(21) Appl. No.: 14/885,930

(22) Filed: Oct. 16, 2015

(65) Prior Publication Data

US 2016/0247629 A1 Aug. 25, 2016

(30) Foreign Application Priority Data

Feb. 24, 2015 (KR) ..... 10-2015-0025969

(51) Int. Cl.
*H01F 27/28* (2006.01)
*H01F 27/34* (2006.01)
*H01F 27/24* (2006.01)

(52) U.S. Cl.
CPC ..... *H01F 27/346* (2013.01); *H01F 27/24* (2013.01); *H01F 27/28* (2013.01); *H01F 27/2823* (2013.01); *H01F 2027/348* (2013.01)

(58) Field of Classification Search
CPC ..... H01F 2027/348
USPC ..... 336/223
See application file for complete search history.

(56) References Cited

U.S. PATENT DOCUMENTS

2015/0109084 A1* 4/2015 Spivak ..... H01F 27/2823 336/90

FOREIGN PATENT DOCUMENTS

| | | |
|---|---|---|
| CH | 474136 | 6/1969 |
| JP | S5476963 | 6/1979 |
| JP | 56147417 | 11/1981 |
| JP | S56152219 | 11/1981 |
| JP | 60103604 | 6/1985 |
| JP | 60-099519 | 7/1985 |
| JP | 61288406 | 12/1986 |
| JP | 7-042959 | 8/1995 |
| JP | H09120922 | 5/1997 |
| JP | 11-087154 | 3/1999 |
| JP | 2003224016 | 8/2003 |

OTHER PUBLICATIONS

Japan Patent Office Application No. 2015-211784, Office Action dated Mar. 28, 2017, 2 pages.

(Continued)

*Primary Examiner* — Ronald Hinson
(74) *Attorney, Agent, or Firm* — K&L Gates LLP

(57) ABSTRACT

Disclosed is a transformer for reducing eddy current losses of a coil, in which a cut part which is provided by removing a portion of a conductor is provided in each of an upper end and a lower end of a coil, and thus, eddy current losses caused by leakage flux are reduced. The transformer includes a core and a first coil and a second coil sequentially installed on a concentric circle to surround the core. A cut part which is provided by removing a portion of a conductor is provided at each of a first outer upper end and a first outer lower end of the first coil and a second inner upper end and a second inner lower end of the second coil to reduce an influence of leakage flux.

3 Claims, 9 Drawing Sheets

(56) References Cited

OTHER PUBLICATIONS

European Patent Office Application Serial No. 15194542.5, Search Report dated Jul. 14, 2016, 8 pages.
Japan Patent Office Application Serial No. 2015-211784, Office Action dated Aug. 2, 2016, 3 pages.

* cited by examiner

【Fig. 1】
Prior Art
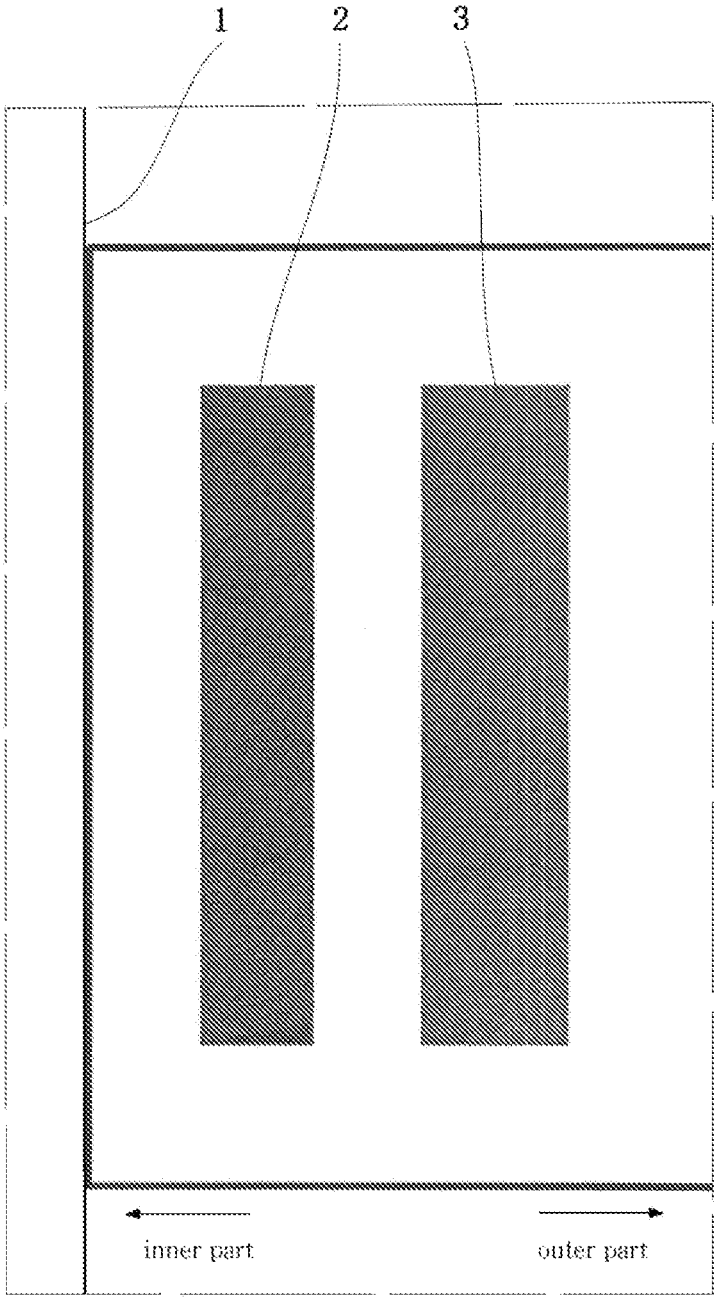

【Fig. 2A】
Prior Art
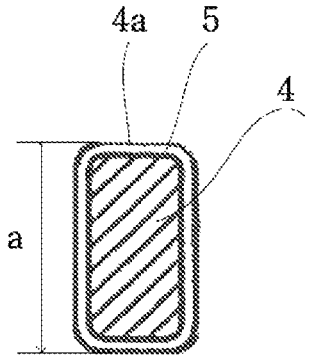
【Fig. 2B】
Prior Art
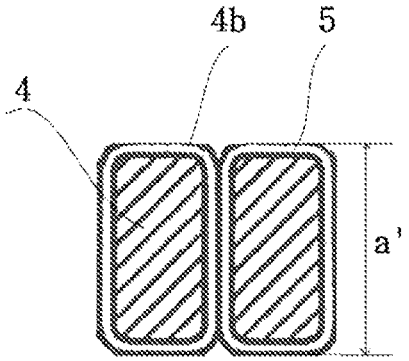

【Fig. 2C】
Prior Art
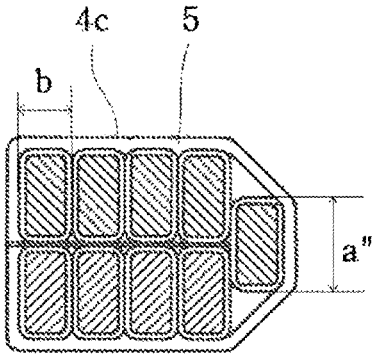

【Fig. 3】
Prior Art
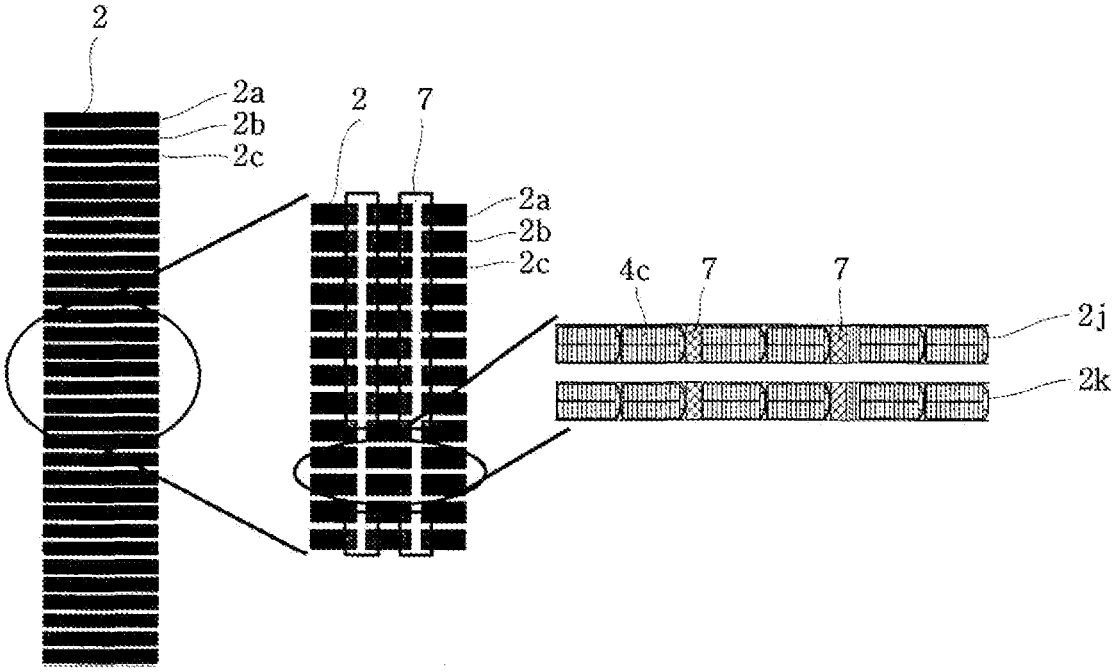

[Fig. 4]
Prior Art
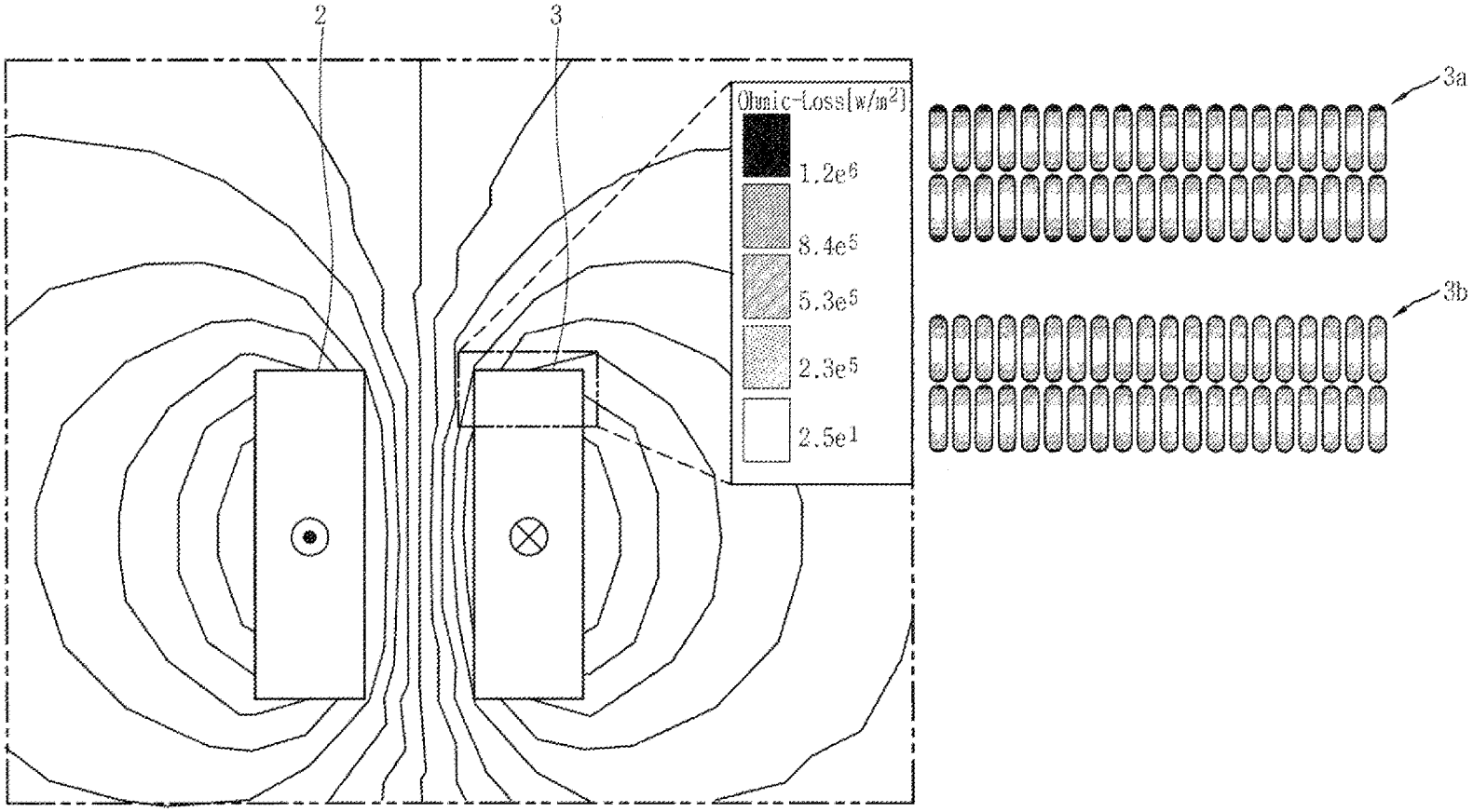

【Fig. 5】
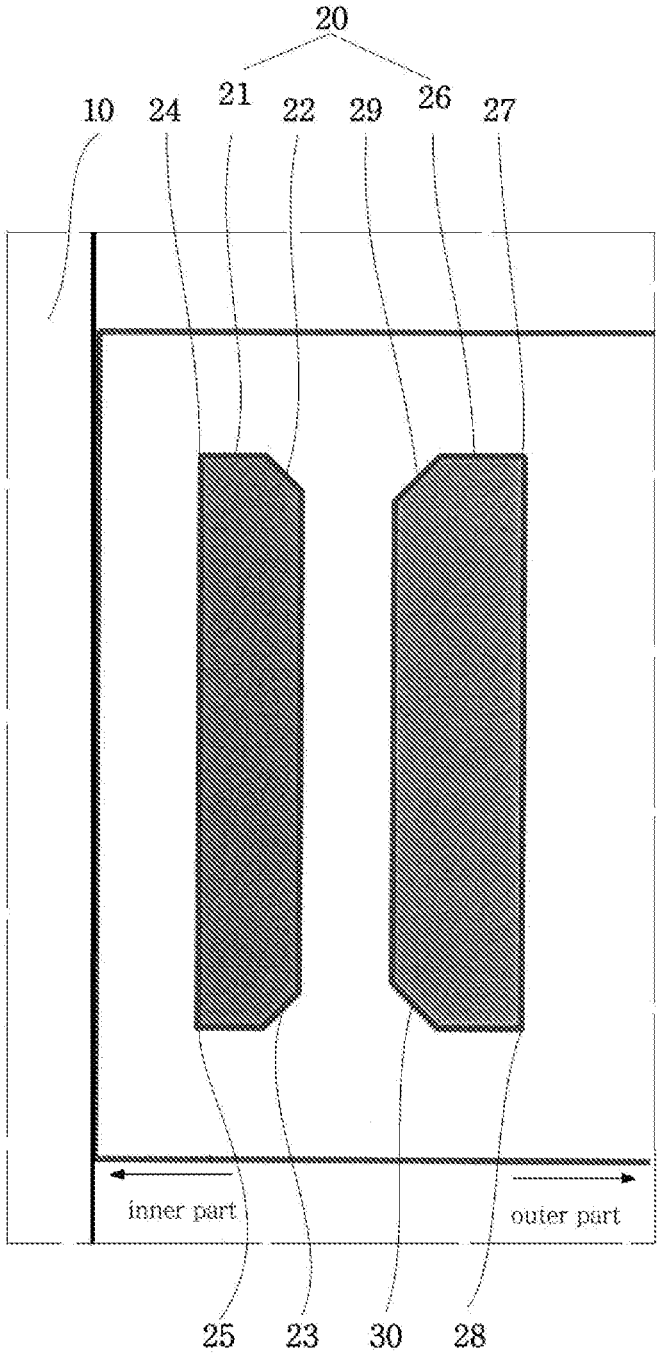

【Fig. 6】
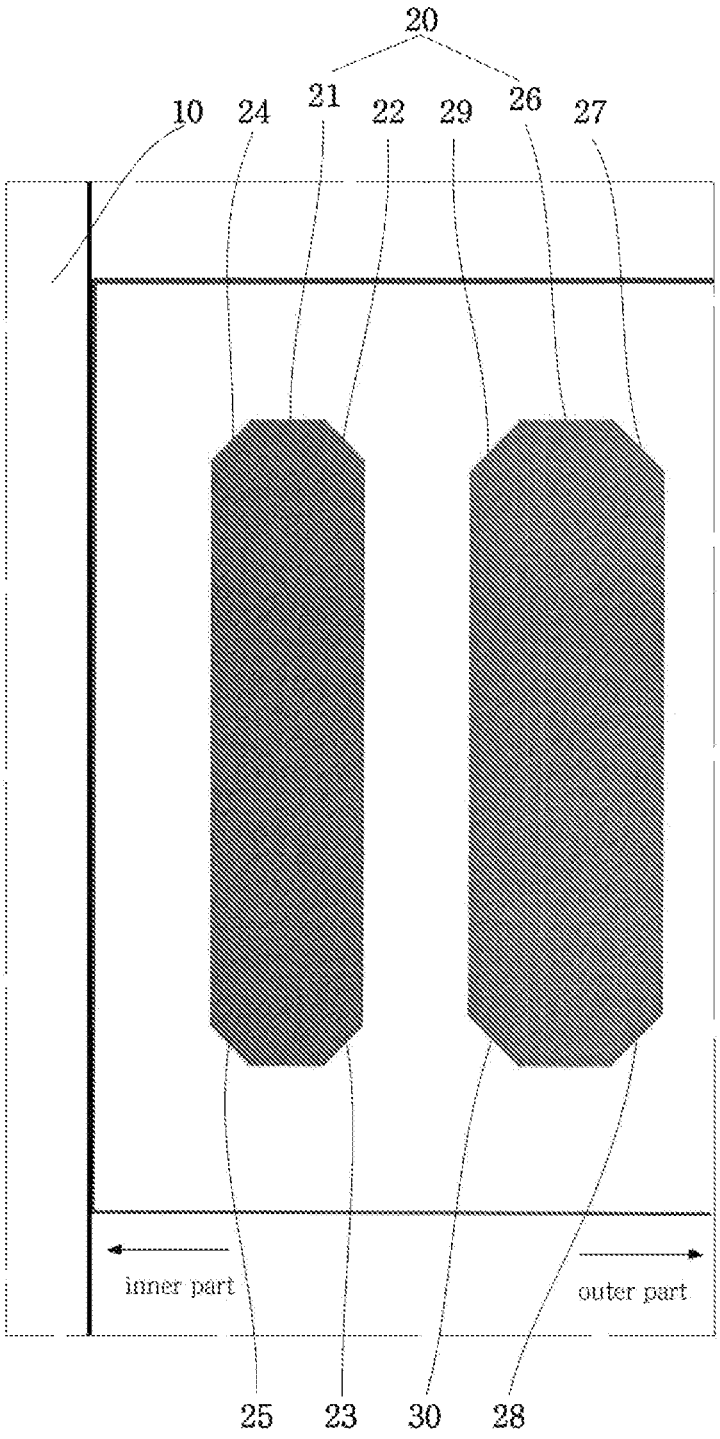

【Fig. 7】
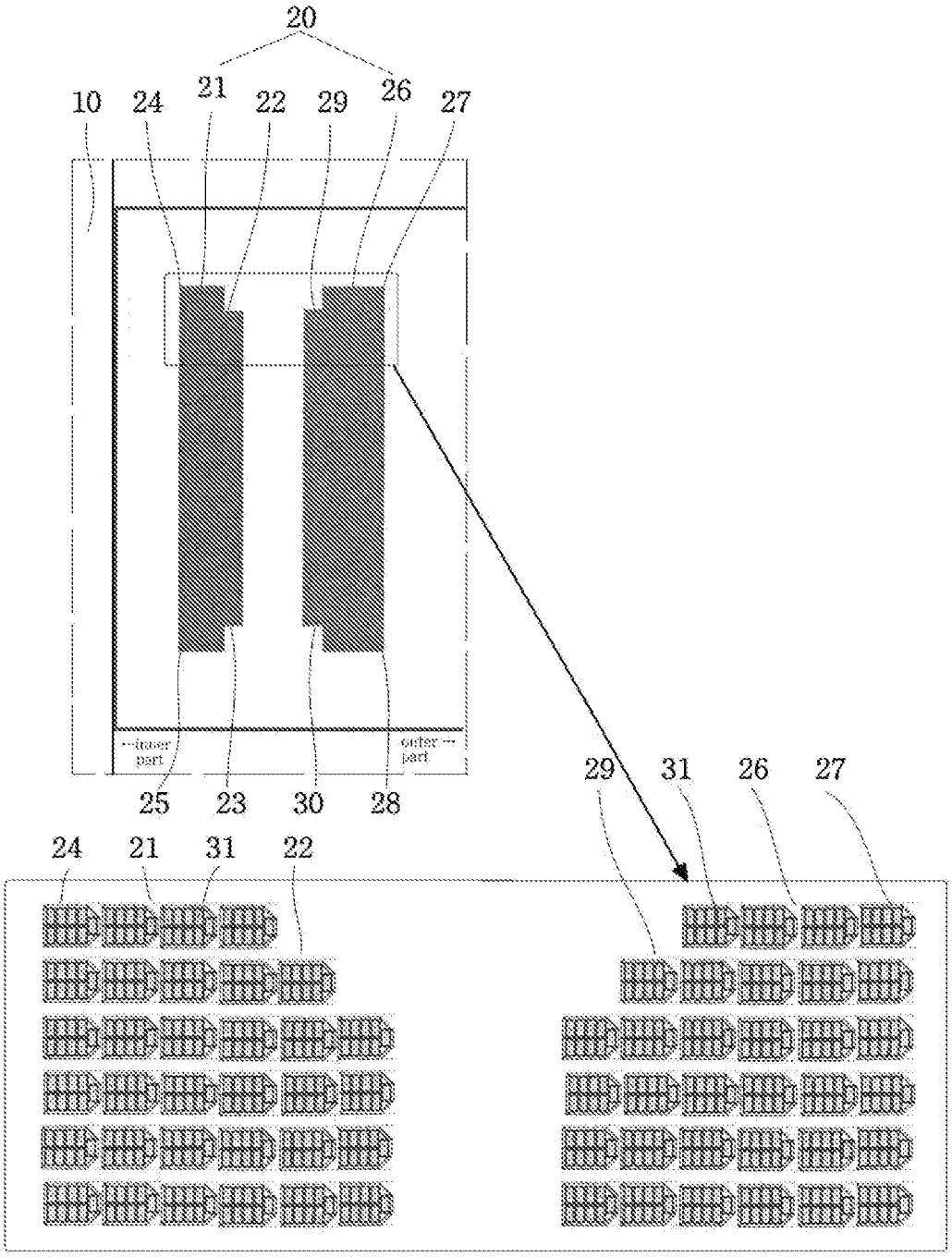

【Fig. 8】
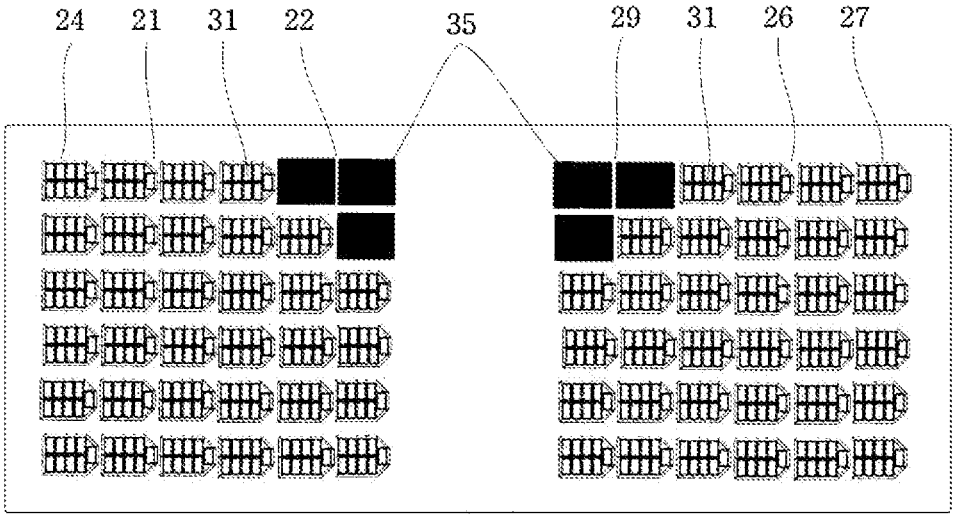

TRANSFORMER FOR REDUCING EDDY CURRENT LOSSES OF COIL

CROSS-REFERENCE TO RELATED APPLICATION

Pursuant to 35 U.S.C. § 119(a), this application claims the benefit of earlier filing date and right of priority to Korean Patent Application No. 10-2015-0025969, filed on Feb. 24, 2015, the contents of which is incorporated by reference herein in its entirety.

BACKGROUND OF THE DISCLOSURE

1. Field of the Disclosure

The present disclosure relates to a transformer for reducing eddy current losses of a coil, and particularly, to a transformer in which a cut part which is provided by removing a portion of a conductor is provided in each of an upper end and a lower end of a coil, and thus, eddy current losses caused by leakage flux are reduced.

2. Background of the Disclosure

Generally, a high voltage power transformer is an electronic device that is provided in a power system and is supplied with a voltage from a power station to boost and lower the voltage. The high voltage power transformer plays an important role in transmitting power to a power consumer.

Electrical loss occur in operating and managing a transformer, and a loss of a transformer is represented by a sum of no load loss, load loss, and loss which occurs in an auxiliary device (a fan, a pump, and/or the like). The no load loss is loss which occurs in a core configuring a transformer, and the load loss is loss which occurs in a coil, a supporting structure near the coil, a tank, and/or the like.

In the load loss, most of losses are direct current (DC) resistance losses caused by a coil resistance, but stray load loss and eddy current loss which occurs in a coil, a supporting structure, and a tank due to leakage flux cannot be neglected. In particular, eddy current loss which occurs in a coil causes local overheating, and is a factor that largely affects long-time operation reliability of a transformer.

FIG. 1 schematically illustrates a cross-sectional view of a core and a coil of a related art transformer. FIGS. 2A to 2C illustrate examples of a conductor applied to a coil of the related art transformer. Here, FIG. 2A illustrates a flat conductor 4*a*, FIG. 2B illustrates a double conductor 4*b*, and FIG. 2C illustrates a transposed conductor 4*c*. FIG. 3 illustrates a detailed cross-sectional view of a coil of the related art transformer.

In the related art transformer, as illustrated in FIG. 1, a plurality of coils 2 and 3 are disposed to form a concentric circle with respect to a coil 1. In FIG. 1, only two coils 2 and 3 are illustrated, but the number of coils may be two or more depending on a place where the transformer is used.

The coils 2 and 3 of the transformer are manufactured by winding the conductors 4 formed of copper, aluminum, and an alloy. The conductors 4 are surrounded by an insulating material 5, for insulating turns of the conductors 4. FIG. 3 illustrates various forms of conductors used for the coils 2 and 3 of the transformer. An obliquely-striped portion refers to the conductor 4, and a portion surrounding the conductor 4 refers to an insulating material.

Referring to FIG. 3, the coil 2 of the transformer is configured by a combination of several pieces of conductors (for example, a combination of sections 2*a*, 2*b*, 2*c*, . . . where the transposed conductor 4*c* is wound). In order to cool the coil 2, a vertical cooling duct 7 may be provided in the coil sections 2*a*, 2*b*, 2*c*, . . . . FIG. 3 illustrates a coil where the transposed conductor 4*c* is used and two vertical cooling ducts 7 are applied for cooling the coil 2.

FIG. 4 illustrates leakage flux of a transformer coil and eddy current loss of a coil end caused by the leakage flux. When power is applied to a primary coil 2 of a transformer, a voltage is induced to a secondary coil 3, and a direction of a current flowing in the secondary coil 3 is opposite to that of a current flowing in the primary coil 2. Due to such an influence, leakage flux largely occurs between the primary coil 2 and the secondary coil 3, and thus, an eddy current is generated near each of the coils 2 and 3, for attenuating the leakage flux. Loss caused by the eddy current is referred to as eddy current loss. The eddy current loss is affected by a level and a direction of leakage flux of a transformer, a dimension of a coil conductor, a current density of a coil, a resistance of a coil, and a power frequency. A portion where a number of eddy current losses caused by leakage flux occurs is an end of a transformer coil, and a local temperature rise (hot-spot) caused by eddy current loss is high measured. Referring to FIG. 4, an eddy current loss of a coil section 3*a* is larger than that of a coil section 3*b*.

As described above, examples of factors affecting the magnitude of eddy current loss which occurs in a coil include a maximum value of leakage flux, an incident direction of leakage flux with respect to a coil, a dimension based on a shape and a size of a coil conductor, a current density of a coil, a resistance of a conductor, and a level of a power frequency. In these factors, a factor for satisfying characteristic (% impedance, a capacity, and/or the like) required by a transformer and adjusting eddy current loss is the dimension of the coil conductor (a, a', a", or be in FIG. 2). Generally, in order to reduce eddy current losses of a coil, the double conductor 4*b* is used instead of the flat conductor 4*a*, and the transposed conductor 4*c* is used instead of the double conductor 4*b*. In coil dimensions, a dimension (a) which the most largely affects an eddy current loss of a coil is illustrated in FIG. 2.

Therefore, the transposed conductor 4*c* where the dimension (a) of the coil conductor is the smallest is used for reducing eddy current losses.

However, in the related art, a method of reducing eddy current losses by adjusting a dimension of a coil conductor has a drawback which is difficult to apply for maintaining mechanical strength. Also, it is required to maintain an appropriate current density of a coil, and thus, a dimension (b) of the conductor should be relatively enlarged for decreasing the dimension (a) of the conductor. For this reason, eddy current loss caused by the dimension (b) increases.

SUMMARY OF THE DISCLOSURE

Therefore, an aspect of the detailed description is to provide a transformer for reducing eddy current losses caused by leakage flux occurring in the transformer.

To achieve these and other advantages and in accordance with the purpose of this specification, as embodied and broadly described herein, a transformer for reducing eddy current losses of a coil includes: a core; and a first coil and a second coil sequentially installed on a concentric circle to surround the core, wherein a cut part which is provided by removing a portion of a conductor is provided at each of a first outer upper end and a first outer lower end of the first coil and a second inner upper end and a second inner lower end of the second coil to reduce an influence of leakage flux.

Here, a cut part which is provided by removing a portion of a conductor may be provided at each of a first inner upper end and a first inner lower end of the first coil and a second outer upper end and a second outer lower end of the second coil to reduce an influence of leakage flux.

Moreover, a cut surface of the cut part may include one of an inclined surface, a round surface, and a stepped surface.

Moreover, an insulating material may be disposed in the cut part.

Moreover, the stepped surface may be provided by adjusting a length of a coil section configuring a layer of each of the first coil and the second coil.

In the transformed for reducing eddy current losses of a coil according to an exemplary embodiment of the present invention, since a cut part is provided at an end of a coil, eddy current losses caused by leakage flux occurring in the transformer are reduced. Therefore, heat is reduced, and thus, a stability of a device is enhanced, and durability increases. Also, since an insulating material is filled into the cut part, short circuit strength is not weakened.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings:

FIG. 1 schematically illustrates a cross-sectional view of a core and a coil of a related art transformer;

FIGS. 2A to 2C illustrate examples of a conductor applied to a coil of the related art transformer, FIG. 2A illustrating a flat conductor, FIG. 2B illustrating a double conductor, and FIG. 2C illustrating a transposed conductor;

FIG. 3 illustrates a detailed cross-sectional view of a coil of the related art transformer;

FIG. 4 illustrates leakage flux and eddy current loss which occur in a primary coil and a secondary coil of the related art transformer;

FIG. 5 is a schematic diagram illustrating cross-sectional surfaces of a core and a coil of a transformer according to an exemplary embodiment of the present invention;

FIG. 6 is a schematic diagram illustrating cross-sectional surfaces of a core and a coil of a transformer according to another exemplary embodiment of the present invention;

FIG. 7 is a schematic diagram illustrating cross-sectional surfaces of a core and a coil of a transformer according to another exemplary embodiment of the present invention; and FIG. 8 is a schematic diagram illustrating cross-sectional surfaces of a core and a coil of a transformer according to another exemplary embodiment of the present invention.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, preferred embodiments of the present invention will be described in detail with reference to the accompanying drawings. However, the embodiments are provided only to disclose the invention in a manner sufficiently clear and complete for the invention to be easily carried out by a person having ordinary skill in the art to which the invention pertains, but do not mean to limit technical ideas and categories of the present invention.

FIG. 5 is a schematic diagram illustrating cross-sectional surfaces of a core and a coil of a transformer according to an exemplary embodiment of the present invention. The transformer for reducing eddy current losses of a coil, according to an exemplary embodiment of the present invention, will be described in detail with reference to the accompanying drawings.

The transformer for reducing eddy current losses of a coil, according to an exemplary embodiment of the present invention, may include a core 10; a first coil 21 and a second coil 26 that are sequentially installed on a concentric circle to surround the core 10. A cut part which is provided by removing a portion of a conductor 31 may be provided at each of a first outer upper end 22 and a first outer lower end 3 of the first coil 21 and a second inner upper end 29 and a second inner lower end 30 of the second coil 26.

The core 10 may be provided to form a flux path and increase a flux density. A material of the core 10 may use a directional silicon steel plate manufactured by a cold rolling method. The core 10 may be surrounded by an insulating tape which is good in thermal characteristic and mechanical characteristic, and anticorrosive paint processing may be performed for a surface of the core 10.

The core 10 may be manufactured by stacking steel plates having the same size. The stacked steel plates may configure a layer constituting one group. A plurality of the layers may be stacked to configure the core 10.

A coil 20 may be installed around the core 10 to surround the core 10 in a concentric shape. A coil which is the most adjacent to the core 10 may be referred to as the first coil 21, and a core which is subsequently installed may be referred to as the second coil 26. The coil 20 may be configured by a more number of layers, but for convenience, two coils will be described as an example. A description of the present embodiment and a description of another exemplary embodiment may be applied to three or more coils.

In a cross-sectional view, a plurality of ends constituting corners of the first coil 21 may be respectively referred to as the first outer upper end 22, the first outer lower end 3, a first inner upper end 24, and a first inner lower end 25.

Likewise, in the cross-sectional view, a plurality of ends constituting corners of the second coil 26 may be respectively referred to as a second outer upper end 27, a second outer lower end 28, the second inner upper end 29, and the second inner lower end 30.

The coil 20 may be provided so that a portion of a conductor corresponding to an end of the coil 20, where an eddy current loss of the coil 20 occurs the most largely, is removed. That is, the cut part may be provided at each of the first outer upper end 22 and the first outer lower end 3 of the first coil 21 and the second inner upper end 29 and the second inner lower end 30 of the second coil 26.

Since the cut part is provided at each of the first outer upper end 22 and the first outer lower end 3 of the first coil 21 and the second inner upper end 29 and the second inner lower end 30 of the second coil 26, eddy current losses caused by leakage flux occurring in each of the ends are reduced.

Here, as illustrated in FIG. 5, the cut part may be provided to have an inclined surface. Alternatively, although not separately shown, the cut part may be provided in a round shape. When a cut surface of each end is provided as an inclined surface or provided in a round shape, a surface similar to the form of leakage flux may be provided, and thus, eddy current losses are minimized by avoiding a portion on which leakage fluxes are concentrated. That is, referring to FIG. 4, eddy current loss that affects a coil of a transformer increases according to a size of a vector that enters from a coil end into a coil conductor in a vertical direction among leakage fluxes, and in this case, since a cut part is provided at an end of a coil, a level of leakage flux that affects a coil end conductor is lowered.

FIG. 6 is a schematic diagram illustrating cross-sectional surfaces of a core and a coil of a transformer according to another exemplary embodiment of the present invention.

In the present embodiment, a plurality of cut parts may be respectively provided at all ends of each of a plurality of coils. That is, a plurality of cut parts may be respectively provided at a first outer upper end 22, a first outer lower end 23, a first inner upper end 24, and a first inner lower end 25 of a first coil 21. Also, a plurality of cut parts may be respectively provided at a second outer upper end 27, a second outer lower end 28, a second inner upper end 29, and a second inner lower end 30 of a second coil 26. Since a plurality of cut parts are respectively provided at all ends of each of a plurality of coils 20, an eddy current caused by leakage flux is reduced as much as possible.

FIG. 7 illustrates a schematic diagram illustrating cross-sectional surfaces of a core and a coil of a transformer according to another exemplary embodiment of the present invention.

In the present embodiment, a cut part which is provided at each of ends of each of a plurality of coils may be provided to have a stepped surface, namely, a stepped shape. This can be clearly seen with reference to a substantial configuration of each of a plurality of conductors 31 configuring a first coil 21 and a second coil 26 illustrated in a detailed diagram. A unit configuring each of the first coil 21 and the second coil 22 is the conductor 31, and thus, when each of a plurality of coils 20 is manufactured by a method of removing the conductor 31, the cut part may be provided in a stepped shape as illustrated in FIG. 7.

Here, the stepped surface may be provided by adjusting a length of a coil section configuring a layer of each of a plurality of coils.

FIG. 8 is a schematic diagram illustrating cross-sectional surfaces of a core and a coil of a transformer according to another exemplary embodiment of the present invention.

In the present embodiment, in each of a plurality of coils 20, an insulating material 35 may be filled into a cut part which is provided by removing a conductor 31. The conductor 31 may be removed from an end of each of the first coil 21 and the second coil 26, and the insulating material 35 may be filled into a corresponding part. Therefore, eddy current losses caused by leakage flux are reduced, and a shape of the coil 20 is maintained. Accordingly, short circuit strength is not weakened.

In the transformed for reducing eddy current losses of a coil according to an exemplary embodiment of the present invention, since a cut part is provided at an end of a coil, eddy current losses caused by leakage flux occurring in the transformer are reduced. Therefore, heat is reduced, and thus, a stability of a device is enhanced, and durability increases. Also, since an insulating material is filled into the cut part, short circuit strength is not weakened.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A transformer for reducing eddy current losses of a coil, the transformer comprising:

a core; and a first coil and a second coil sequentially installed on a concentric circle to surround the core, wherein the first and second coils comprise a transposed conductor, wherein a first cut part is provided to reduce an influence of leakage flux by removing a portion at the end of the transposed conductor at each of a first outer upper end and a first outer lower end of the first coil and at each of a first inner upper end and a first inner lower end of the second coil, and wherein an insulating material is located in the first cut part.

2. The transformer of claim 1, wherein a cut surface of the second cut part comprises an inclined surface, a round surface, or a stepped surface.

3. The transformer of claim 1, wherein a cut surface of the first cut part comprises an inclined surface, a round surface, or a stepped surface.

* * * * *